US005139073A

United States Patent [19]

Opdahl et al.

[11] Patent Number: 5,139,073

[45] Date of Patent: Aug. 18, 1992

[54] TAPE DRUM FOR A VENETIAN BLIND TILT ASSEMBLY

[75] Inventors: Barry J. Opdahl, Williamsport; Timothy E. Schoener, Cogan Station; Gerald R. Franzen, Lewisburg, all of Pa.

[73] Assignee: Springs Window Fashions Division, Inc., Middleton, Wis.

[21] Appl. No.: 682,145

[22] Filed: Apr. 8, 1991

[51] Int. Cl.[5] ..... E06B 9/38

[52] U.S. Cl. ..... 160/177; 160/176.1

[58] Field of Search ..... 160/177, 176.1, 178.1, 160/236; 248/68.1

[56] References Cited

U.S. PATENT DOCUMENTS 4,244,544 1/1981 Kornat ..... 248/68.1
4,416,320 11/1983 Nordin ..... 160/177
4,697,629 10/1987 Anderson ..... 160/177
4,799,641 1/1989 Koreski ..... 248/68.1

*Primary Examiner*—Blair M. Johnson
*Attorney, Agent, or Firm*—Lerner, David, Littenberg, Krumholz & Mentlik

[57] ABSTRACT

A tape drum provides an improved method for operatively coupling a ladder tape to a tilt rod in a venetian blind headrail assembly. The tape drum includes a receiving cavity and resilient opposed retaining members for retaining the tape drum in assembled position on the tilt rod. A slot on either side of the receiving cavity holds the portions at one end of the ladder tape in position across the receiving cavity so that, upon assembly of the tape drum to the tilt rod, the end portions of the ladder tape will be compressively engaged between the retaining members and the tilt rod.

33 Claims, 9 Drawing Sheets

TAPE DRUM FOR A VENETIAN BLIND TILT ASSEMBLY

FIELD OF THE INVENTION

The present invention relates to assemblies for tilting the slats of a venetian blind. More particularly, the present invention relates to a tape drum for connecting a ladder tape to the tilt rod of a venetian blind assembly.

BACKGROUND OF THE INVENTION

The horizontal slats of a venetian blind are typically held in spaced relation to one another by two or more ladder tapes which are supported by an assembly mounted near the top of a window opening. The assembly generally includes a tilt rod and two or more tape drums for connecting the free ends of the ladder tape to the tilt rod. As a tilt mechanism is operated to rotate the tilt rod, the tape drum rotates with it. As a result, one side of the ladder tape is raised while the other side is lowered, thereby causing the venetian blind slats to tilt about their longitudinal axes.

The assembly of the ladder tapes to the tape drums has heretofore been a difficult and very labor-intensive process. In one such process, the tape drum is first assembled onto the tilt rod which is then assembled inside of the venetian blind headrail. Subsequently, the free ends of the ladder tape are assembled to the tape drum. This assembly process is extremely difficult and slow since the individual performing the assembly must work within the confines of the headrail in order to assemble the ladder tape to the tape drum.

In order to obviate this difficulty, tape drums have been developed in which the ladder tape is first assembled to the tape drum, after which the tape drum is press fit onto the tilt rod which has already been assembled in the headrail. In one form of tape drum, shown in FIGS. 1 and 2, which is currently available for use in this assembly technique, the free ends of the ladder tape are fitted with metal clips which are securely held in place in the tape drum. While this assembly technique makes it much easier to connect the tape drum to the tilt rod, other assembly difficulties are created thereby. Firstly, this assembly method is relatively costly in that it requires a full inventory of metal clips to be maintained, as well as a ready supply of hand tools for assembling the clips to the ladder tape. Also, the need to first attach the clips to the ladder tapes adds an extra step in the venetian blind assembly process. Furthermore, the crimping of the metal clips to the ladder tape requires a significant amount of hand strength, and this therefore becomes more difficult towards the end of the work shift as the assemblers' hands begin to tire. Moreover, assemblers who have performed the crimping process over extended periods of time have experienced numerous medical problems. More significant among these is carpal tunnel syndrome, the treatment of which has oftentimes required surgery, and which therefore has resulted in increased medical and insurance costs to manufacturers in addition to the increased costs associated with having to train new employees in the requisite assembly skills.

There therefore exists a need for an improved tape drum which will overcome the numerous deficiencies of the tape drums which are currently available. In particular, the need exists for a tape drum to which a ladder tape may be readily connected outside of a venetian blind headrail, and which can then be readily connected in assembled position to a tilt rod inside of the venetian blind headrail.

SUMMARY OF THE INVENTION

In accordance with the present invention, it has now been discovered that the foregoing and other shortcomings can be obviated by the invention of an improved tape drum for operatively coupling a ladder tape to a tilt rod in a venetian blind. The tape drum includes a body having a receiving cavity, retaining means for retaining the tilt rod within the receiving cavity in assembled relationship, and securing means for securing the ladder tape in contact with the tilt rod within the receiving cavity.

In accordance with one embodiment of the tape drum of the present invention, the securing means consists of a portion of the body forming the receiving cavity. In a preferred embodiment, the securing means includes rib members for exerting a compressive force on the ladder tape against the tilt rod. In an even more preferred embodiment, the rib members include a first rib member disposed on one side of the receiving cavity and a second rib member disposed on another side of the receiving cavity opposite the one side.

In accordance with another embodiment of the tape drum of the present invention, the retaining means consists of at least two spaced retaining members. Preferably, the at least two spaced retaining members are resiliently displaceable in opposite directions for inserting the tilt rod into the receiving cavity in assembled relationship. In more preferred embodiments, the retaining members include hook means adapted to engage an edge of the tilt rod to retain the tilt rod within the receiving cavity in assembled relationship.

In accordance with another embodiment of the present invention, the tape drum further includes engagement means for engaging the ladder tape exterior of the receiving cavity. In a preferred embodiment the engagement means consists of means defining a first slot on one side of the receiving cavity and means defining a second slot on another side of the receiving cavity opposite the one side. In a more preferred embodiment of the tape drum, the ladder tape includes thick portions and thin portions and each of the first and second slots are sized to engage the thin portions of the ladder tape. In a highly preferred embodiment, each of the first and second slots include a V-shaped protruding member for engaging the thin portions of the ladder tape.

In accordance with yet another embodiment of the tape drum of the present invention, the body includes a first convexly curved outer edge on one side of the receiving cavity and a second convexly curved outer edge on another side of the receiving cavity opposite the one side. In a highly preferred embodiment, this tape drum further includes a first aperture disposed between the receiving cavity and the first outer edge of the body and a second aperture disposed between the receiving cavity and the second outer edge of the body, the first and second apertures adapted to receive first and second end portions of the ladder tape through the body.

Another aspect of the present invention provides a tilt assembly for a venetian blind consisting of a tape drum having a receiving cavity, a tilt rod connected to the tape drum within the receiving cavity, and a ladder tape having a free end including first and second end portions secured within the receiving cavity by the connection between the tilt rod and the tape drum.

In one embodiment of this tilt assembly, the tape drum further includes retaining means for retaining the tilt rod within the cavity in assembled relationship. In a preferred embodiment the retaining means consists of at least two spaced retaining members resiliently displaceable in opposite directions for inserting the tilt rod into the receiving cavity in assembled relationship. In a more preferred embodiment, each of the retaining members include hook means adapted to engage an edge of the tilt rod to retain the tilt rod within the receiving cavity in assembled relationship.

In another embodiment of this tilt assembly, the tape drum further includes securing means for securing the ladder tape in contact with the tilt rod within the receiving cavity. Preferably, the securing means consists of a portion of the tape drum forming the receiving cavity. More preferably, the securing means includes rib members for exerting a compressive force on the ladder tape against the tilt rod. In a highly preferred embodiment, the rib members consist of a first rib member disposed on one side of the receiving cavity and a second rib member disposed on another side of the receiving cavity opposite the one side.

In yet another embodiment of the tilt assembly, the tape drum further consists of engagement means for engaging the ladder tape exterior of the receiving cavity. In a preferred embodiment the engagement means consists of means defining a first slot on one side of the receiving cavity and means defining a second slot on another side of the receiving cavity opposite the one side. In a more preferred embodiment, the ladder tape includes thick portions and thin portions and each of the first and second slots are sized to engage the thin portions. In a highly preferred embodiment, each of the first and second slots include a V-shaped protruding member for engaging the thin portions of the ladder tape.

In yet another embodiment of the tilt assembly, the tape drum includes a first convexly curved outer edge on one side of the receiving cavity and a second convexly curved outer edge on another side of the receiving cavity opposite the one side. A highly preferred embodiment of this tilt assembly further includes a first aperture disposed between the receiving cavity and the first outer edge of the tape drum and a second aperture disposed between the receiving cavity and the second outer edge of the tape drum, the first and second apertures adapted to receive first and second end portions of the ladder tape through the tape drum.

Yet another aspect of the present invention provides a venetian blind consisting of a tape drum having a receiving cavity, a tilt rod connected to the tape drum within the receiving cavity, a ladder tape having a free end including first and second end portions secured within the receiving cavity by the connection between the tilt rod and the tape drum, means for rotating the tilt rod, and a plurality of spaced slats supported by the ladder tape and tiltable upon rotation of the tilt rod.

Still another aspect of the present invention provides a method for coupling a ladder tape having first and second end portions to a tilt rod in a venetian blind tilt assembly, the tilt assembly including a tape drum having first and second sides and a receiving cavity disposed between the first and second sides. In accordance with this method, a first end portion of the ladder tape is positioned on the first side of the tape drum, a second end portion of the ladder tape is positioned on the second side of the tape drum, the first end portion of the ladder tape is maneuvered across the receiving cavity towards the second side of the tape drum, the second end portion of the ladder tape is maneuvered across the receiving cavity towards the first side of the tape drum, and the tilt rod is connected to the tape drum within the receiving cavity whereby the first and second end portions of ladder tape are securely engaged within the receiving cavity between the tilt rod and a portion of the tape drum forming the receiving cavity.

In a preferred method in accordance with the present invention, the first and second end portions of the ladder tape are connected to the first and second sides of the tape drum exterior of the receiving cavity.

In another embodiment of the method of the present invention, the tape drum includes an aperture formed in each of the first and second sides, and the positioning step consists of inserting the first end portion of the ladder tape through the aperture in the first side of the tape drum and inserting the second end portion of the ladder tape through the aperture in the second side of the tape drum. In accordance with a highly preferred embodiment of the present invention, the first and second sides of the tape drum include outer edges and the method includes the steps of inverting the tape drum and arranging the ladder tape along the outer edges of the tape drum.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF A PREFERRED EMBODIMENT

Figure 1:
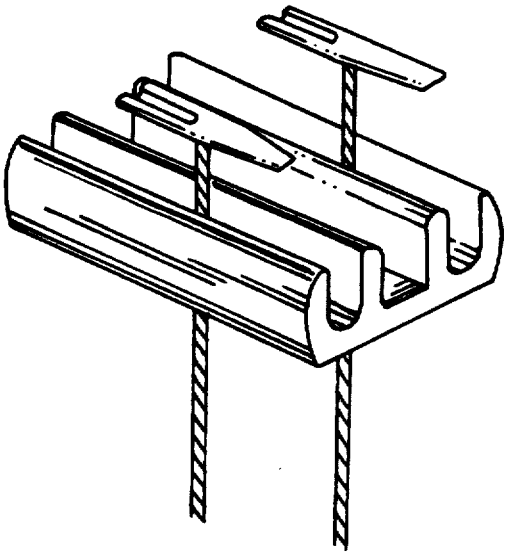
FIG. 1 PRIOR ART
FIG. 1 is a perspective view of a prior art tape drum showing/the ends of a ladder tape in position for assembly thereto.
Figure 2:
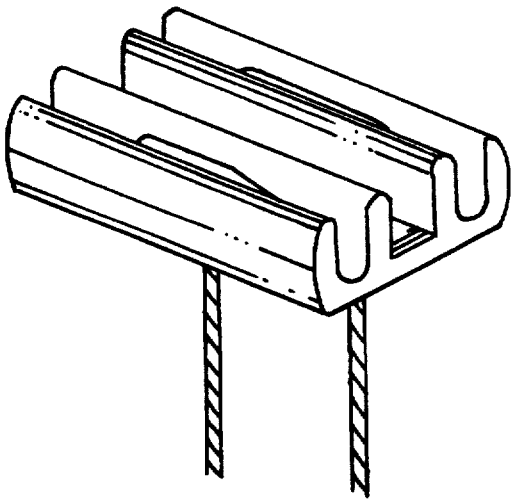
FIG. 2 PRIOR ART
FIG. 2 is a perspective view of the prior art tape drum of FIG. 1 showing the ladder tape in assembled position.
Figure 3:
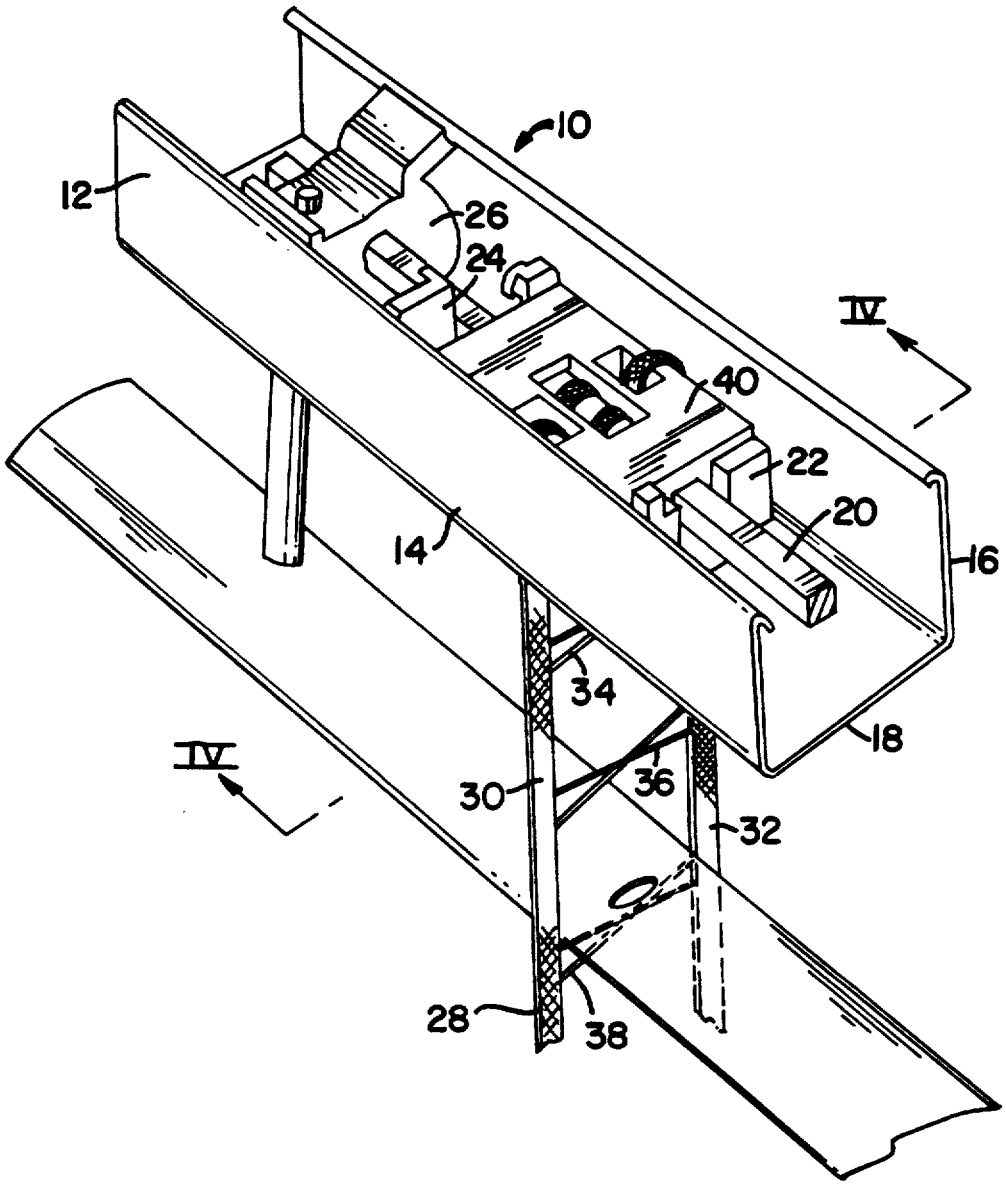
FIG. 3 is a perspective view of the tape drum of the present in assembled position in a venetian blind headrail.
Figure 4:
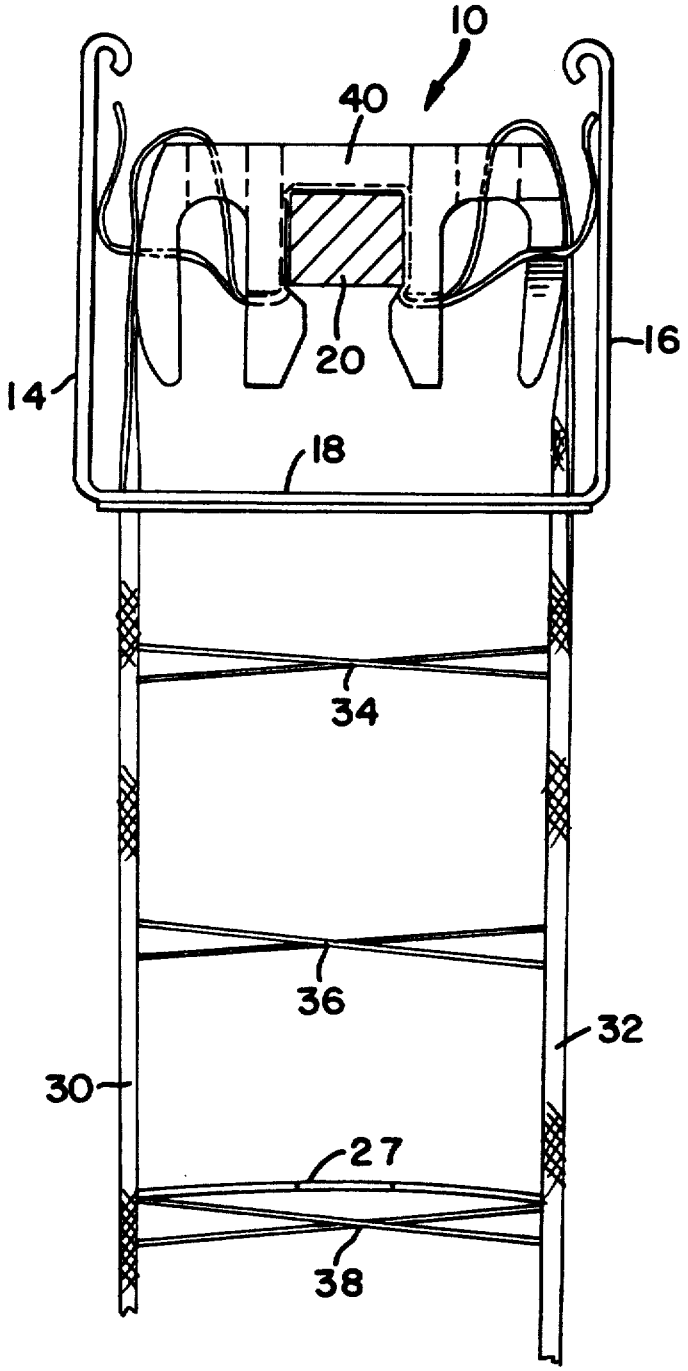
FIG. 4 is a cross-sectional view taken on line IV—IV of the venetian blind headrail assembly shown in FIG. 3 with the other headrail components removed for clarity.

Referring to FIGS. 3 and 4, there is illustrated a headrail assembly 10 in accordance with the present invention. Headrail assembly 10 includes a conventional U-shaped headrail 12 having vertically extending legs 14 and 16 joined by a horizontal web 18. A tilt rod 20 which runs almost the entire length of headrail 12 is longitudinally supported therein by a pair of spaced support members 22 and 24. Tilt rod 20 has a generally square cross-section and is formed from a strong, rigid material, such as steel, which is capable of supporting the combined weight of the venetian blind slats with little or no deflection. Depending on the lengths of headrail 12 and tilt rod 20, headrail assembly 10 may include additional support members disposed at spaced intervals in order to provide tilt rod 20 with sufficient support to avoid bending. At one end, tilt rod 20 is connected to a tilt mechanism 26 which operates in a manner generally known in the art to rotate tilt rod 20 in either a forward or backward direction. The individual slats of the venetian blind, one of which is shown at 27 are typically supported by at least two ladder tapes which, in their fully extended position, extend from headrail assembly 10 the length of the window opening. One such ladder tape is shown at 28 and includes flexible side portions 30 and 32 and a plurality of cross members. Although only three such cross members 34, 36 and 38 are illustrated, it will be readily appreciated that the ladder tape will include a sufficient number of cross members to support the quantity of slats required to cover the given window opening. The free ends of side portions 30 and 32 extend through an aperture (not shown) in the bottom web 18 of headrail 12, and are operatively connected to tilt rod 20 by tape drum 40 constructed in accordance with the present invention. Typically, headrail assembly 10 will also include other components which have not been shown, but which are required for the proper operation of the venetian blind, such as a cord for raising and lowering the venetian blind slats to desired positions.

Figure 5:
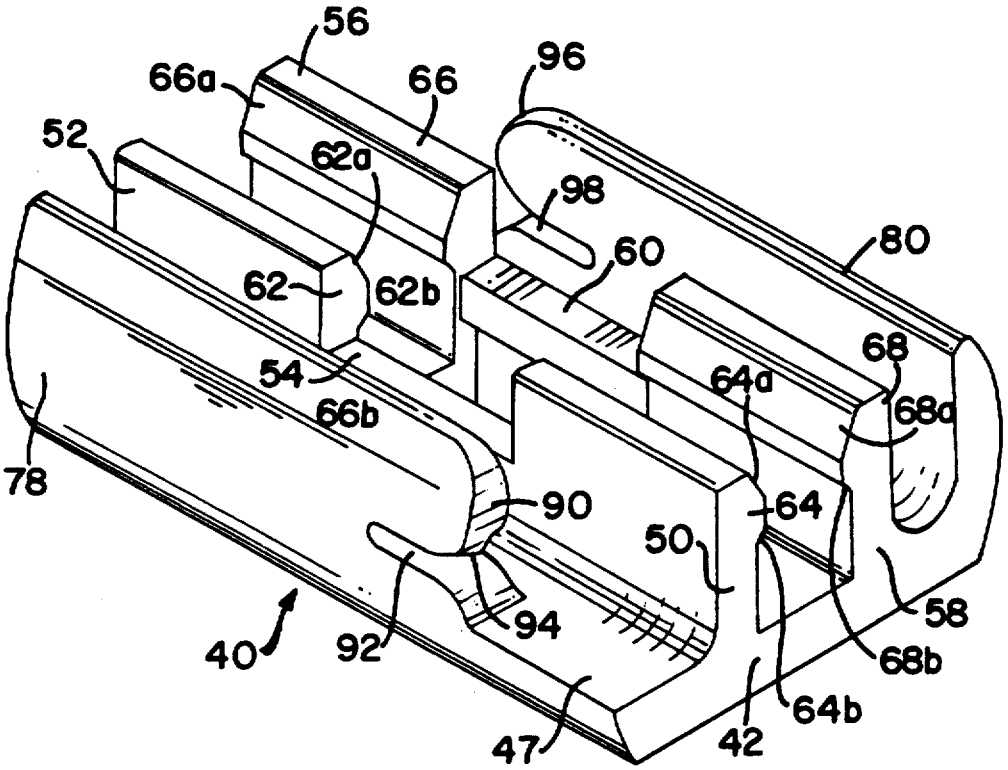
FIG. 5 is a perspective view of the tape drum of the present invention.
Figure 6:
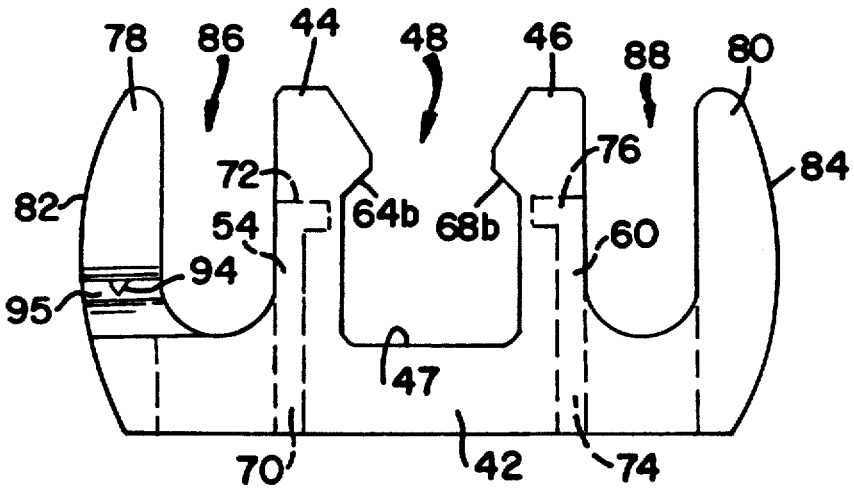
FIG. 6 is an end view of the tape drum shown in FIG. 5.

Tape drum 40 is formed from a resilient material, preferably a resilient plastic such as polypropylene or other like material and, as shown in FIGS. 5 and 6, consists of a generally flat member 42 having longitudinal connecting members 44 and 46 extending generally perpendicularly from one face 47 thereof and defining a longitudinal channel 48 therebetween. As will be discussed further below, longitudinal channel 48 has an essentially square crosssection which is sized and shaped to matingly receive tilt rod 20. Connecting member 44 consists of two connecting portions 50 and 52 which are separated by a web 54 having a height and a thickness that are less than that of connecting member 44. Similarly, connecting member 46 includes connecting portions 56 and 58 which are separated by web 60 having a height and a thickness that are less than that of connecting member 46.

The free ends of connecting portions 50 and 52 include hook members 62 and 64, respectively, while the free ends of connecting portions 56 and 58 include hook members 66 and 68, respectively. The upper portion of each hook member includes an inwardly tapered surface, as at 62*a*, 64*a*, 66*a* and 68*a*, to facilitate the installation of tape drum 40 onto tilt rod 20, and an outwardly tapered surface as at 62*b*, 64*b*, 66*b*, and 68*b* to retain the tape drum 40 in place once installed.

Web 54 is shown in FIG. 6 to include a lower portion 70 having a substantially uniform cross-section and a rib 72 disposed along the top thereof, rib 72 being thicker in cross-section than lower portion 70. Similarly, web 60 is shown as including a lower portion 74 having a substantially uniform cross-section and a rib 76 disposed along the top thereof, rib 76 being thicker in cross-section than lower portion 74. Lower portions 70 and 74 are sized to be thinner than ribs 72 and 76 by making the distance between lower portions 70 and 74 greater than the distance between ribs 72 and 76.

Tape drum 40 further includes two longitudinal legs 78 and 80 which extend upwardly in a generally perpendicular direction from the longitudinal edges of flat member 42. As can be clearly seen in FIG. 6, both of legs 78 and 80 have convexly curved outer surfaces 82 and 84, respectively, which form the longitudinal sides of tape drum 40. Thus, leg 78 extends upwardly along one edge of flat member 42 a spaced distance from connecting member 44, thereby defining a channel 86 therebetween. Leg 80 extends upwardly along the opposite edge of flat member 42 a spaced distance from connecting member 46 to thereby define a channel 88 therebetween. As clearly seen in the figures, legs 78 and 80 do not extend the entire length of tape drum 40. Leg 78 extends from one end of tape drum 40 and terminates at a curved end 90. Extending inwardly from the curved end 90 of leg 78 is a slot 92 which includes an elongated V-shaped protrusion 94 that projects from one face of slot 92 towards the other face thereof to form a gap 95 therebetween. Leg 80, on the other hand, extends from the opposite end of tape drum 40 and terminates at curved end 96. A slot 98 extends inwardly from the curved end 96 of leg 80 and includes an elongated V-shaped protrusion 97 which is substantially the same as V-shaped protrusion 94, and which projects from one face of slot 98 towards the other face thereof to form a gap (not shown) therebetween which is substantially the same size as gap 95.

Figure 7:
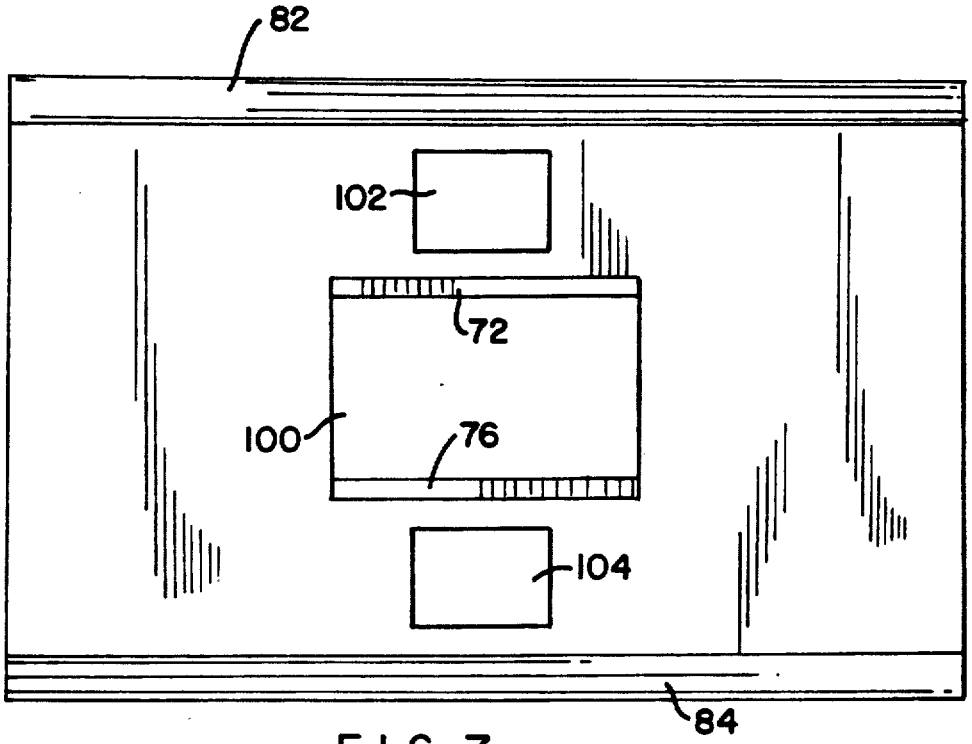
FIG. 7 is a top plan view of the tape drum shown in FIG. 5.
Figure 8:
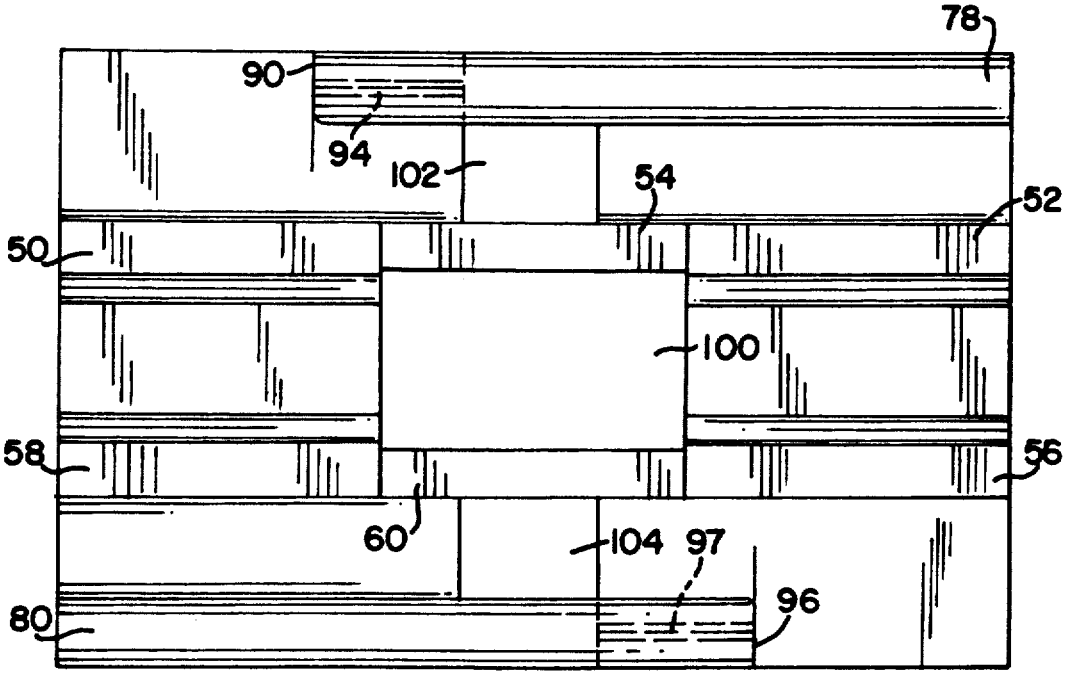
FIG. 8 is a bottom plan view of the tape drum shown in FIG. 5.
Figure 9:
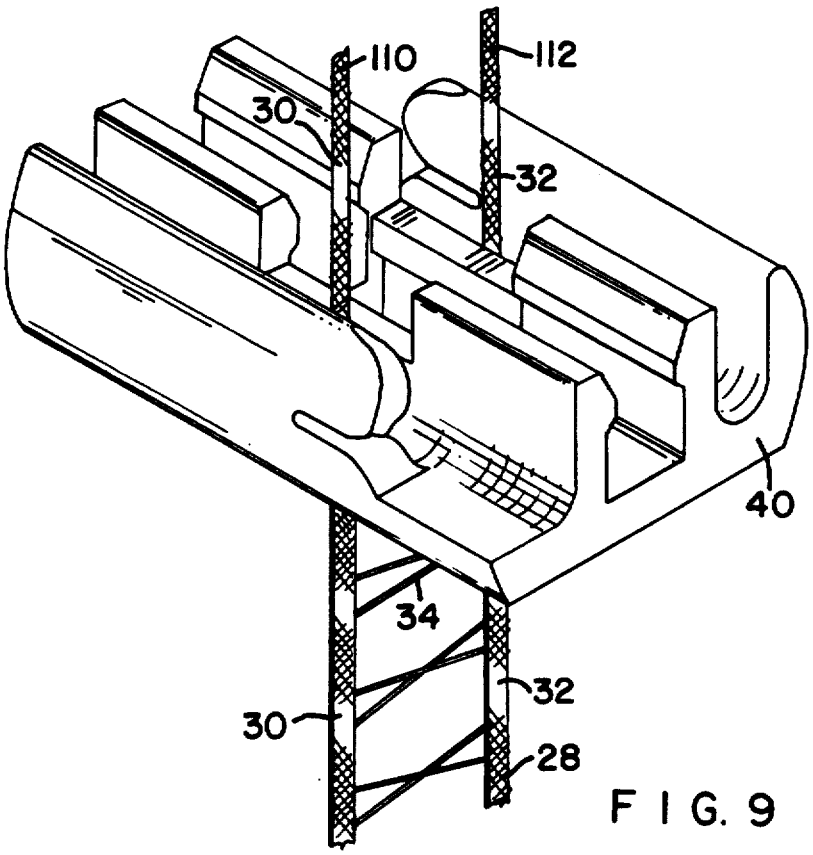
FIGS. 9-12 are perspective views showing the steps of assembling a ladder tape to the tape drum of FIG. 5 and then to a tilt rod.

Referring to FIGS. 7 and 8, it can be seen that flat member 42 has three apertures formed therein, a large aperture 100 which opens into channel 48, and two smaller apertures 102 and 104 which open into channels 86 and 88, respectively.

Figure 10:
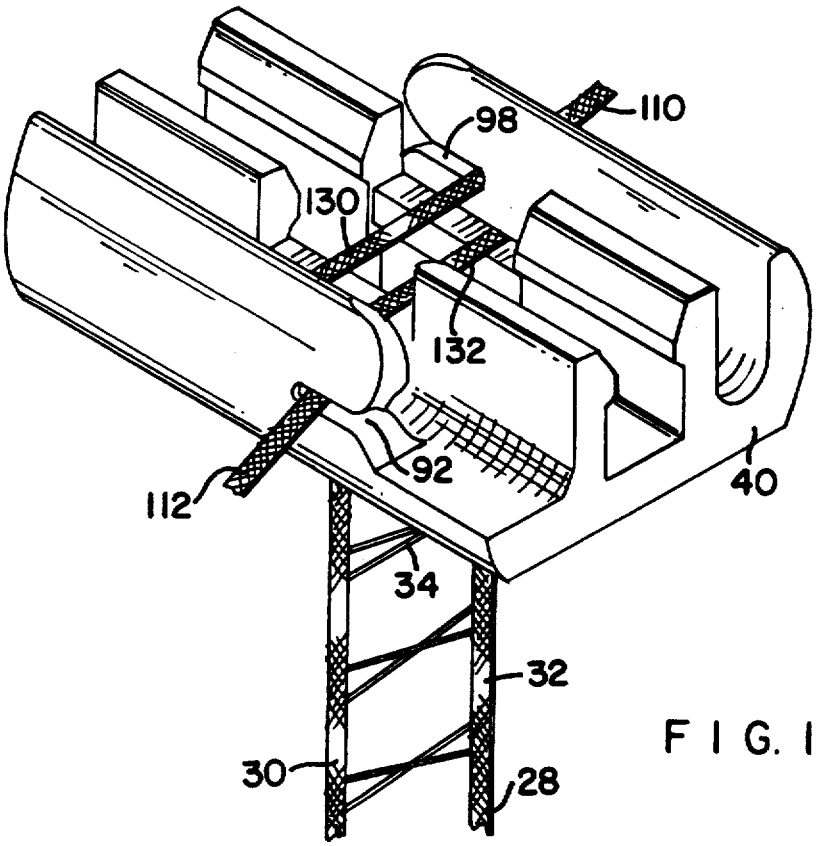

The aforementioned construction of tape drum 40 facilitates the installation of ladder tape 28 to headrail assembly 10. In a typical assembly procedure, headrail 12 will be preassembled with tilt mechanism 26, support members 22 and 24, and tilt rod 20. Other operating components which are typically assembled in the headrail 12 may be assembled therein during the preassembly stage. Once the desired preassembly of headrail assembly 10 has been completed, the assembly of ladder tape 28 thereto can be completed in a relatively simple procedure which can best be understood by reference to FIGS. 9–12. In accordance with this procedure, the ends 110 and 112 of side portions 30 and 32 of ladder tape 28 are first threaded upwardly through an aperture in the bottom web 18 of headrail 12. Tape drum 40 is then threaded onto ladder tape 28 in a position outside of headrail 10 by inserting end 110 through aperture 102 and end 112 through aperture 104. The position of tape drum 40 on ladder tape 28 is next adjusted so that tape drum 40 lies a predetermined distance from the first ladder tape cross member 34. Once so aligned, end 110 of the ladder tape is crossed over rib 72, channel 48, rib 76 and channel 88 and is inserted for engagement in slot 98. Similarly, end 112 of the ladder tape is crossed over rib 76, channel 48, rib 72 and channel 86 and is inserted for engagement in slot 92, all of which is shown in FIG. 10. These assembly steps are quite easily accomplished since they can be performed outside of the headrail 12 and need not be performed within the small confines within the headrail.

Figure 13:
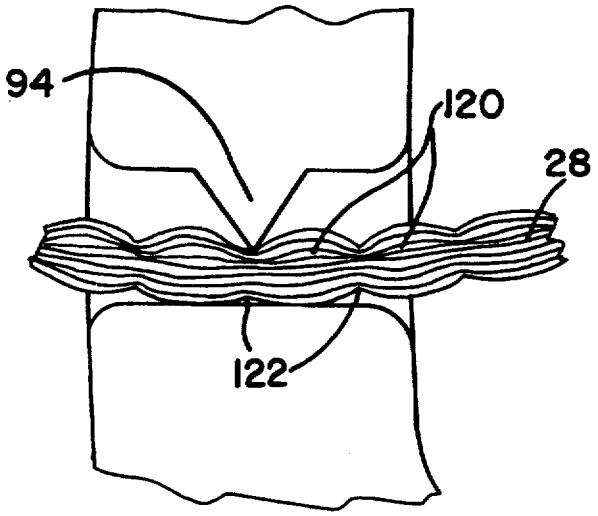
FIG. 13 is an enlarged view showing the engagement of a ladder tape in the slot of the tape drum of the present invention.

The configuration of slots 92 and 98 is such that ends 110 and 112 of ladder tape 28 may be readily inserted therein, yet firmly held in place. This is accomplished by taking advantage of the peculiar crosssection which is characteristic of these ladder tapes. Thus, as shown in the enlarged view of FIG. 13, ladder tape 28 has a profile which resembles a string of pearls in that it consists of alternating thicker portions 120 and thinner portions 122. By sizing V-shaped protrusion 94 so that gap 95 is large enough to accept the thinner portions 122 of ladder tape 28, yet too small to accept the thicker portions 120 thereof, ladder tape 28 will be held rather firmly in place and substantially prevented from sliding longitudinally through slot 92. The gap in slot 98 is similarly sized to firmly retain ladder tape 28 therein.

Figure 11:
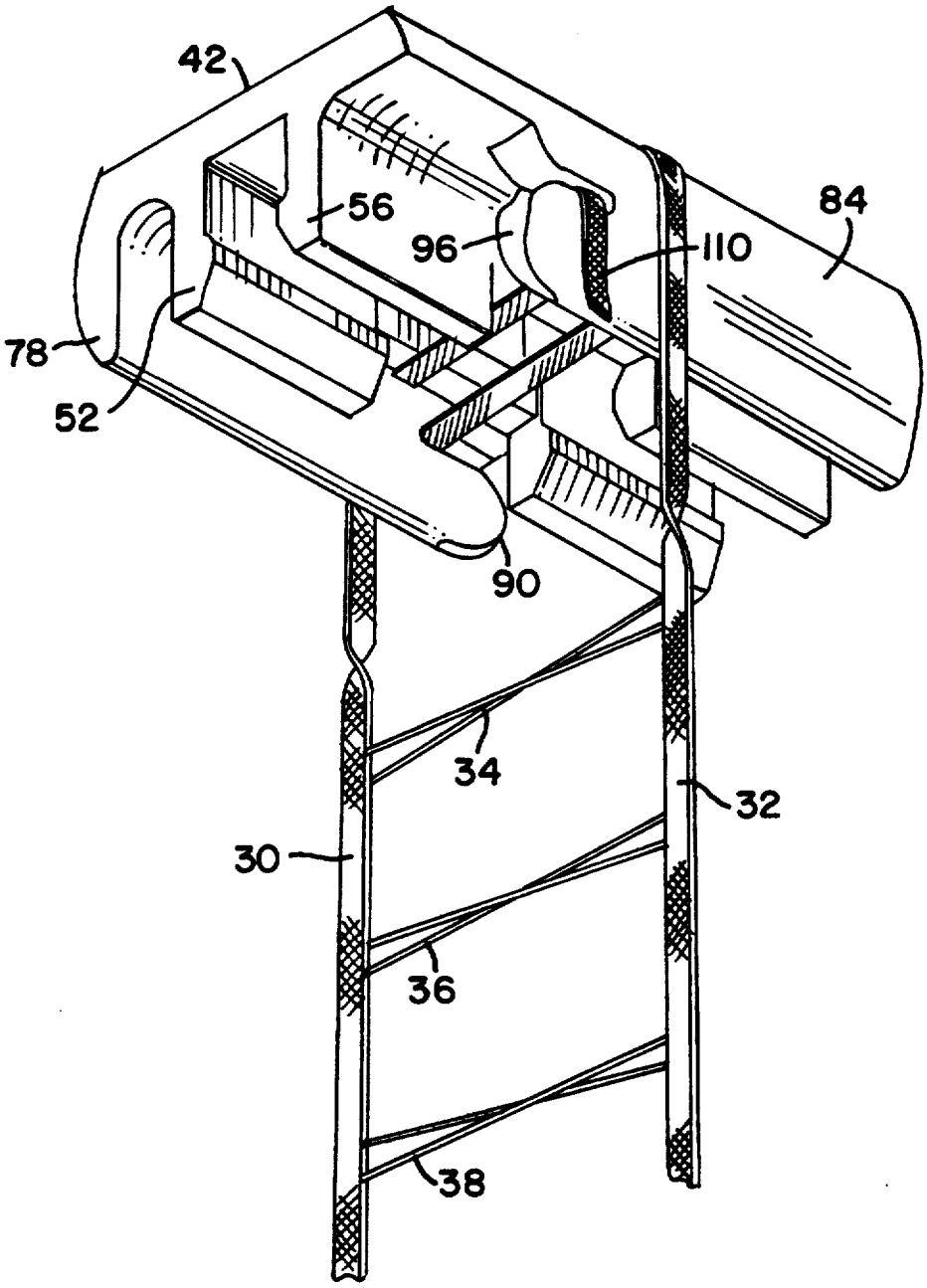
Figure 12:
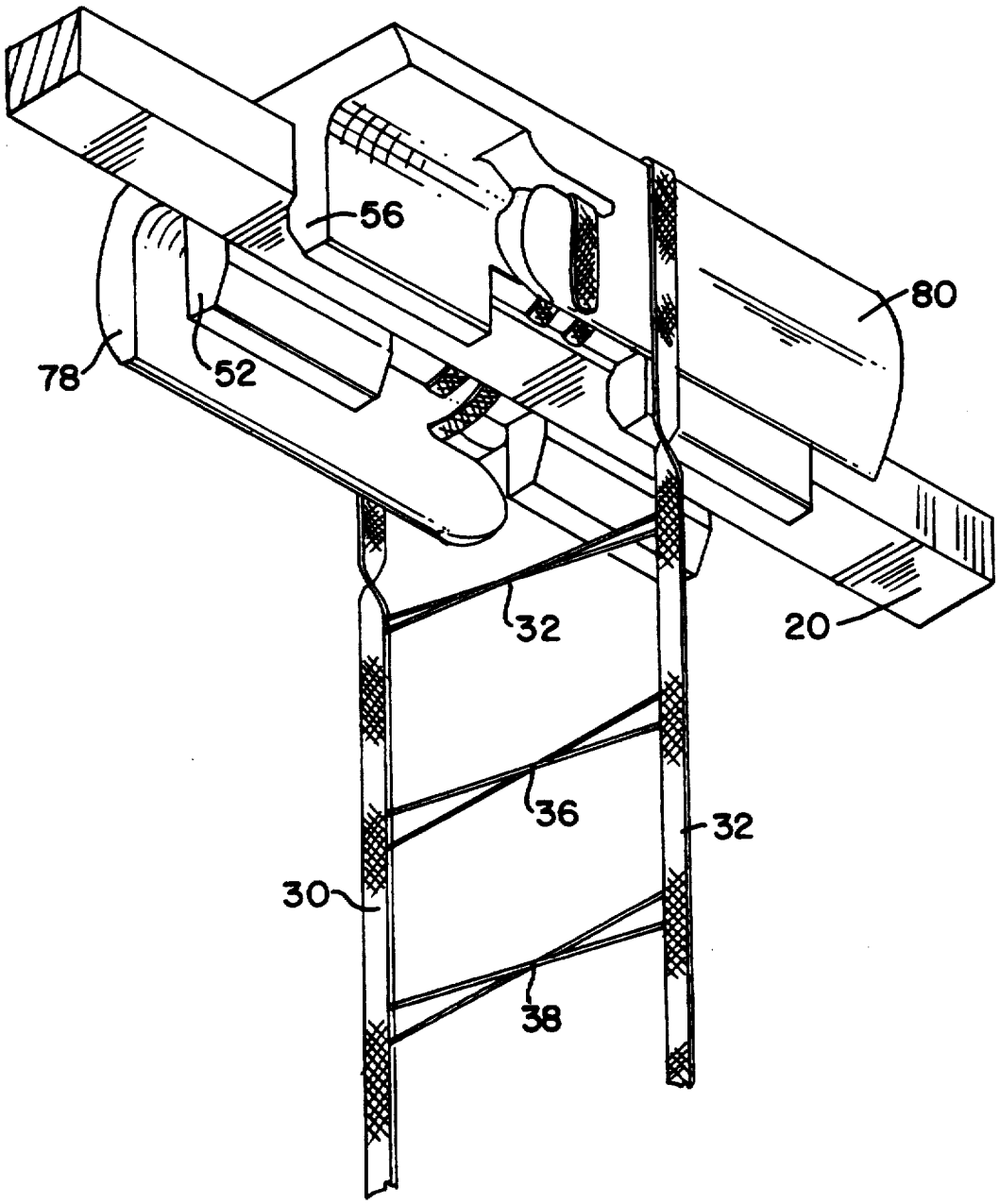

After ends 110 and 112 of the ladder tape have been engaged in slots 98 and 92, respectively, tape drum 40 is inverted, as shown in FIG. 11, so that the side portions 30 and 32 of the ladder tape 28 drape over the curved surfaces 82 and 84 on the sides of tape drum 40. Once inverted in this manner, tape drum 40 is in position for connection to the tilt rod 20 in assembled position in headrail 12.

The assembly of tape drum 40 onto tilt rod 20 is accomplished very simply by first aligning the longitudinal channel 48 of tape drum 40 over tilt rod 20, and then applying a downward pressure to tape drum 40. As tapered surfaces **62*a*, 64*a*, 66*a* and 68*a* engage tilt rod 20, there is a relative movement of connecting portions 50 and 52 away from connecting portions 56 and 58, thereby permitting tilt rod 20 to enter channel 48. As it does so, tilt rod 20 pushes the portions 130 and 132 of ladder tape 28 spanning channel 48 ahead of it. The firm engagement of ends 110 and 112 in slots 98 and 92 keeps these ends in place as portions 130 and 132 are pushed into channel 48. Hence, only by the advancing of side portions 30 and 32 of ladder tape 28 through apertures 102 and 104 are portions 130 and 132 able to move into channel 48. Continued downward pressure on tape drum 40 causes tilt rod 20 and ladder tape portions 130 and 132 to be driven deeper into channel 48, further separating connecting portions 50 and 52 from connecting portions 56 and 58, until the outwardly tapered surfaces 62*b*, 64*b*, 66*b*, and 68*b* on hook members 62, 64, 66 and 68 snap under the lower edge of tilt rod 20. At this point, tape drum 40 will be securely locked in place on tilt rod 20 and portions 130 and 132 of ladder tape 28 will be compressed between tilt rod 20 and ribs 72 and 76 forming a part of channel 48. Since tape drum 40 has to move a predetermined distance to reach this assembled position on tilt rod 20, it will be readily apparent that the side portions 30 and 32 of ladder tape 28, as well as the cross members therebetween, will move twice that distance during the assembly procedure. Accordingly, it is an easy task to properly position tape drum 40 on ladder tape 28 at the beginning of the assembly process to achieve a desired distance between cross member 34 and web 18 of headrail 12** once the assembly has been completed.

In order for tape drum 40 to perform as intended, the thicknesses of connecting portions 44 and 46 and webs 54 and 60 must be carefully chosen. Specifically, connecting members 44 and 46 must be thin enough that they will readily flex outwardly to accept tilt rod 20 therebetween, while at the same time be sufficiently thick that they will securely hold tape drum 40 in place on tilt rod 20. On one hand, if connecting members 44 and 46 are too thin, tape drum 40 may become disconnected from tilt rod 20 during the conventional operation of the venetian blind. On the other hand, if connecting members 44 and 46 are too thick, it will be difficult to flex them outwardly, and, as a result, the assembly of tape drum 40 to tilt rod 20 will be difficult to make.

The thicknesses of webs 54 and 60 are similarly important. During the assembly of tape drum 40 to tilt rod 20, the compression of portions 130 and 132 of ladder tape 28 between tilt rod 20 and ribs 72 and 76 will cause webs 54 and 60 to flex outwardly in order to accommodate the thickness of the ladder tape. Hence, if webs 54 and 60 are too thick, they will not readily flex and the assembly of tape drum 40 to tilt rod 20 will be extremely difficult. On the other hand, if webs 54 and 60 are too thin, they will flex all too readily and thus not exert a sufficient compressive force against portions 130 and 132 of ladder tape 28 to hold same securely in place. Forming webs 54 and 56 with relatively thin lower portions and a thicker rib disposed along the tops thereof obviates any difficulties in this regard. Thus, when tape drum 40 is in assembled position on tilt rod 20, the compressive force against portions 130 and 132 of ladder tape 28 is effectively concentrated along ribs 72 and 76, and is not distributed over the entirety of webs 54 and 60.

To tilt the venetian blind slats in a forward or backward direction, tilt mechanism 26 is operated in a known fashion. The operation of tilt mechanism 26 causes the rotation of tilt rod 20 about its longitudinal axis and with it, tape drum 40. Referring to FIG. 4, as tilt rod 20 is rotated in a clockwise direction, side portion 32 of ladder tape 28 will move downwardly, while side portion 30 will move upwardly, thereby orienting cross members 34, 36, and 38, and the venetian blind slats supported thereon, at an oblique angle with respect to the bottom web 18 of headrail 12. Similarly, rotating tilt rod 20 in a counterclockwise direction will cause side portion 30 of ladder tape 28 to move downwardly and side portion 32 to move upwardly, thereby orienting cross members 34, 36, and 38, and the venetian blind slats supported thereon, at an oblique angle with respect to the bottom web 18 of headrail 12 in the opposite direction. During the rotation of tape drum 40, side portions 30 and 32 of the ladder tape will maintain their position in general alignment with apertures 102 and 104. However, should side portion 30 become displaced beyond end 90 of leg 78, or side portion 32 become displaced beyond the end 96 of leg 80, the curved configuration of ends 90 and 96 will prevent the side portions of the ladder tape from becoming caught thereon, and they will thus right themselves in their proper position upon rotation of tape drum 40 during the normal tilting process.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised without departing from the spirit and scope of the present invention as set forth in the appended claims.

We claim:

1. A tape drum for operatively coupling a ladder tape to a tilt rod in a venetian blind, comprising a body having a first end and a second end and defining a receiving cavity having at least one open side extending from said first end to said second end, said receiving cavity defining a non-arcuate cross-section, retaining means for retaining said tilt rod within said receiving cavity in assembled relationship, attachment means for attaching said ladder tape exterior of said receiving cavity so that first and second end portions of said ladder tape extend across said at least one open side of said receiving cavity, and securing means for securing said ladder tape in contact with said tilt rod within said receiving cavity, said securing means including rib members for exerting a compressive force on said ladder tape against said tilt rod.

2. A tape drum as claimed in claim 1 wherein said securing means comprises a portion of said body forming said receiving cavity.

3. A tape drum as claimed in claim 1 wherein said receiving cavity has a non-arcuate cross-section.

4. A tape drum as claimed in claim 1 further comprising a first rib member disposed on one side of said receiving cavity and a second rib member disposed on another side of said receiving cavity opposite said one side.

5. A tape drum as claimed in claim 1 wherein said retaining means comprises at least two spaced retaining members.

6. A tape drum as claimed in claim 5 wherein said at least two spaced retaining members are resiliently displaceable in opposite directions for inserting said tilt rod into said receiving cavity in assembled relationship.

7. A tape drum as claimed in claim 6 wherein each of said retaining members include hook means adapted to engage an edge of said tilt rod to retain said tilt rod within said receiving cavity in assembled relationship.

8. A tape drum as claimed in claim 1 wherein said attachment means comprises means defining a first slot on one side of said receiving cavity and means defining a second slot on another side of said receiving cavity opposite said one side.

9. A tape drum as claimed in claim 8 wherein said tape includes thick portions and thin portions, and wherein each of said first and second slots are sized to engage said thin portions of said ladder tape.

10. A tape drum as claimed in claim 9 wherein each of said first and second slots include a V-shaped protruding member for engaging said thin portions of said ladder tape.

11. A tape drum as claimed in claim 1 wherein said body includes a first convexly curved outer edge on one side of said receiving cavity and a second convexly curved outer edge on another side of said receiving cavity opposite said one side.

12. A tape drum as claimed in claim 11 further comprising a first aperture disposed between said receiving cavity and said first outer edge of said body and a second aperture disposed between said receiving cavity and said second outer edge of said body, said first and second apertures adapted to receive said first and second end portions of said ladder tape through said body.

13. A tilt assembly for a venetian blind, comprising a ladder tape having a free end including first and second end portions, a tape drum having a first end and a second end and including a receiving cavity having at least one open side extending from said first end to said second end and attachment means for attaching said first and second end portions of said ladder tape so that said first and second end portions extend across said at least one open side of said receiving cavity, and a tilt rod connected to said tape drum within said receiving cavity so that said first and second end portions of said ladder tape are secured within said receiving cavity by the connection between said tilt rod and said tape drum.

14. A tilt assembly as claimed in claim 13 wherein said tape drum further includes retaining means for retaining said tilt rod within said receiving cavity in assembled relationship.

15. A tilt assembly as claimed in claim 14 wherein said retaining means comprises at least two spaced retaining members resiliently displaceable in opposite directions for inserting said tilt rod into said receiving cavity in assembled relationship.

16. A tilt assembly as claimed in claim 15 wherein each of said retaining members include hook means adapted to engage an edge of said tilt rod to retain said tilt rod within said receiving cavity in assembled relationship.

17. A tilt assembly as claimed in claim 13 wherein said tape drum further includes securing means for securing said ladder tape in contact with said tilt rod within said receiving cavity.

18. A tilt assembly as claimed in claim 17 wherein said securing means comprises a portion of said tape drum forming said receiving cavity.

19. A tilt assembly as claimed in claim 18 wherein securing means includes rib members for exerting a compressive force on said ladder tape against said tilt rod.

20. A tilt assembly as claimed in claim 19 further comprising a first rib member disposed on one side of said receiving cavity and a second rib member disposed on another side of said receiving cavity opposite said one side.

21. A tilt assembly as claimed in claim 13 wherein said attachment means comprises means defining a first slot on one side of said receiving cavity and means defining a second slot on another side of said receiving cavity opposite said one side.

22. A tilt assembly as claimed in claim 21 wherein said ladder tape includes thick portions and thin portions, and wherein each of said first and second slots are sized to engage said thin portions of said ladder tape.

23. A tilt assembly as claimed in claim 22 wherein each of said first and second slots include a V-shaped protruding member for engaging said thin portions of said ladder tape.

24. A tilt assembly as claimed in claim 13 wherein tape drum includes a first convexly curved outer edge on one side of said receiving cavity and a second convexly curved outer edge on another side of said receiving cavity opposite said one side.

25. A tilt assembly as claimed in claim 24 further comprising a first aperture disposed between said receiving cavity and said first outer edge of said tape drum and a second aperture disposed between said receiving cavity and said second outer edge of said tape drum, said first and second apertures adapted to receive first and second end portions of said ladder tape through said tape drum.

26. A venetian blind, comprising a ladder tape having a free end including first and second end portions, a tape drum having a first end and a second end and including a receiving cavity having at least one open side extending from said first end to said second end and attachment means for attaching said first and second ends of said ladder tape so that said first and second ends extend across said at least one open side of said receiving cavity, a tilt rod connected to said tape drum within said receiving cavity so that said first and second end portions of said ladder tape are secured within said receiving cavity by the connection between said tilt rod and said tape drum, means for rotating said tilt rod, and a plurality of spaced slats supported by said ladder tape and tiltable upon rotation of said tilt rod.

27. A method for coupling a ladder tape having first and second end portions to a tilt rod in a venetian blind tilt assembly, said tilt assembly including a tape drum having first and second sides and a receiving cavity disposed between said first and second sides, said method comprising the steps of:

attaching said first end portion of said ladder tape on said side of said tape drum, attaching said second end portion of said ladder tape on said second side of said tape drum, maneuvering said first end portion of said ladder tape across said receiving cavity toward said second side of said tape drum, maneuvering said second end portion of said ladder tape across said receiving cavity toward said first side of said tape drum, and connecting said tilt rod to said tape drum within said receiving cavity whereby said first and second end portions of said ladder tape are securely engaged within said receiving cavity between said tilt rod and a portion of said tape drum forming said receiving cavity.

28. A method as claimed in claim 27 wherein said drum includes an aperture formed in each of said first and second sides, and wherein said attaching step comprises inserting said first end portion of said ladder tape through an aperture in side of said tape drum and inserting said second end portion of said ladder tape through an aperture in said second side of said tape drum.

29. A method as claimed in claim 27 wherein said first and second sides of said tape drum include outer edges, said method further comprising the steps of:

inverting said tape drum and arranging said ladder tape along said outer edges of said tape drum.

30. A tape drum for operatively coupling a ladder tape to a tilt rod in a venetian blind, comprising a body having a first end and a second end and defining a receiving cavity having at least one open side extending from said first end to said second end, said receiving cavity defining a non-arcuate cross-section, retaining means for retaining said tilt rod within said receiving cavity in assembled relationship, securing means for securing said ladder tape in contact with said tilt rod within said receiving cavity, and attachment means for attaching said ladder tape exterior of said receiving cavity so that first and second end portions of said ladder tape extend across said at least one open side of said receiving cavity, said attachment means including means defining a first slot on one side of said receiving cavity and means defining a second slot on another side of said receiving cavity opposite said one side.

31. A tape drum as claimed in claim 39 wherein said ladder tape includes thick portions and thin portions, and wherein each of said first and second slots are sized to engage said thin portions of said ladder tape.

32. A tape drum as claimed in claim 31 wherein each of said first and second slots include a V-shaped protruding member for engaging said thin portions of said ladder tape.

33. A tilt assembly as claimed in claim 13, wherein said receiving cavity has a non-arcuate cross-section.

* * * * *

UNITED STATES PATENT AND TRADEMARK OFFICE

CERTIFICATE OF CORRECTION

PATENT NO. : 5,139,073

DATED : August 18, 1992

INVENTOR(S) : Opdahl et al.

It is certified that error appears in the above-indentified patent and that said Letters Patent is hereby corrected as shown below:

Column 11, line 21, "said side" should read --said first side--.

Column 11, line 39, "drum includes" should read --tape drum includes--.

Column 12, line 1, "in side" should read --in said first side--.

Column 12, line 4, "claim 27" should read --claim 28--.

Column 12, line 29, "claim 39" should read --claim 30--.

Signed and Sealed this

Thirty-first Day of August, 1993

Bruce Lehman

*Attest:*

BRUCE LEHMAN

*Attesting Officer*

*Commissioner of Patents and Trademarks*